US005839921A

United States Patent [19]

Yamanashi

[11] Patent Number: 5,839,921

[45] Date of Patent: Nov. 24, 1998

[54] TERMINAL EXTRACTING ASSEMBLY

[75] Inventor: Makoto Yamanashi, Shizuoka-ken, Japan

[73] Assignee: Yazaki Corporation, Tokyo, Japan

[21] Appl. No.: 728,605

[22] Filed: Oct. 10, 1996

[30] Foreign Application Priority Data

Oct. 13, 1995 [JP] Japan ..... 7-265709

[51] Int. Cl.[6] ..... H01R 13/40

[52] U.S. Cl. ..... 439/595

[58] Field of Search ..... 439/595, 594, 439/752, 592

[56] References Cited

FOREIGN PATENT DOCUMENTS

| | | |
|---|---|---|
| 57-138285 | 8/1982 | Japan . |
| 1-62672 | 4/1989 | Japan . |
| 4-95366 | 3/1992 | Japan . |
| 4-334888 | 11/1992 | Japan . |
| 7-113836 | 5/1995 | Japan . |

*Primary Examiner*—Khiem Nguyen
*Assistant Examiner*—Eugene G. Byrd
*Attorney, Agent, or Firm*—Finnegan, Henderson, Farabow, Garrett & Dunner, L.L.P.

[57] ABSTRACT

A terminal extracting arrangement consists of a connector and a terminal extracting tool. The connector includes a connector housing having a terminal accommodating chamber, a tool hole and a flexible lance. The lance is provided with an engagement projection for engagement with a terminal, and a leading projection for engagement with the tool. The terminal extracting tool includes a rod-shaped leading end provided with a slanted face. In order to avoid a collision of a tip of the tool with a front face of the engagement projection, an angle θ of the slanted face of the tool is equal to or more than an angle α of a tangential line linking a sliding point on the leading projection with another sliding point on the engagement projection. In the relationship, both of the sliding points are included within a range of height H of the slanted face and the angle α is an angle defined by the tangential line and the inserting direction of the terminal extracting tool.

7 Claims, 3 Drawing Sheets

TERMINAL EXTRACTING ASSEMBLY

BACKGROUND OF THE INVENTION

The present invention relates to a terminal extracting assembly consisting of a connector for accommodating a terminal therein and a terminal extracting tool for extracting the terminal from the connector. More particularly, it relates to a terminal extracting tool and a connector having a connector housing provided with a terminal accommodating chamber into which the tool is to be inserted.

A conventional connector is normally provided with a flexible lance (flexible engagement arm) which prevents a terminal, which has been inserted from the rear of a connector housing, from being extracted backwardly.

Such a connector is disclosed in Japanese Unexamined Patent Publication (Kokai) Nos. 4-95366 and 4-334888. FIGS. 1A, 1B and 1C show various operating conditions of the conventional connector and the conventional terminal extracting tool.

In the figures, reference numeral 1 designates a connector housing constituting the connector, 2 a terminal accommodating chamber in which a not-shown terminal is to be accommodated, 5 a flexible lance, 6 an engagement projection, and 7 a leading projection.

In the conventional terminal extracting arrangement, as shown in FIGS. 1A and 1B, when a terminal extracting tool 20 is gradually inserted into the terminal accommodating chamber 2, the leading projection 7 of the flexible lance 5 can be picked up by a slanted face 21 of the tool 20.

However, since the slanted face 21 is at an acute angle θ to the flexible lance 5, a tip 21*a* of the slanted face 21 may collide against a front face of the engagement projection 6, as shown in FIG. 1C. In such a case, due to the collision, the engagement projection 6 cannot be picked up by the tool 20.

Under such a condition, if a tool hole 12 had a room in height allowing the tool to be displaced, it would be possible to bend the flexible lance 5 upwardly by lifting the leading end of the tool 20 obliquely as fulcrums of upper and lower walls of tool hole 12. However, actually, it is impossible to lift the tool 20 in the tool hole 12 because the connector housing 1 is so formed that the upper and lower wall of the tool hole 12 serve to guide a straight insertion of the tool 20 into the terminal accommodating chamber 2.

Thus, in the conventional arrangement, even if the tool 20 is further inserted into the chamber 2, it is impossible to bend the flexible lance 5 furthermore, so that the engagement of the lance 5 with the terminal cannot be released disadvantageously.

SUMMARY OF THE INVENTION

It is therefore an object of the present invention to provide a terminal extracting arrangement which is capable of extracting the inserted terminal from the connector with certainty.

The object of the present invention described above can be accomplished by a terminal extracting assembly for extracting a terminal inserted into a connector therefrom, the terminal extracting arrangement comprising, in combination:

the connector including:

a connector housing having a terminal accommodating chamber formed to accommodate the terminal therein;

a tool hole formed at a front end of the connector housing;

a flexible lance formed in the terminal accommodating chamber, the flexible lance having a free end extending toward the front end, whereby the flexible lance is capable of bending in a direction of height of the terminal accommodating chamber;

an engagement projection formed at a part of the free end of the flexible lance to project to a direction of bending thereof; and a leading projection formed at a part of the free end of the flexible lance to project toward the front end;

wherein the terminal can be prevented from escaping from the terminal accommodating chamber by an engagement of the engagement projection with a shoulder of the terminal; and a terminal extracting tool to be inserted into the terminal accommodating chamber through the tool hole for releasing an engagement of the flexible lance with the terminal, the terminal extracting tool including a rod-shaped leading end provided with a slanted face which is inclined to the inserting direction of the terminal;

wherein an angle θ of the slanted face is established to be equal to or more than an angle α of a tangential line linking a sliding point on the leading projection with another sliding point on the engagement projection, both of the sliding points being included within a range of height H of the slanted face;

wherein the angle α is an angle defined by the tangential line and the inserting direction of the terminal extracting tool.

With the arrangement mentioned above, when the leading end of the terminal extracting tool is inserted into the terminal accommodating chamber through the tool hole, the slanted face of the tool abuts on the leading projection of the flexible lance. Further, with the further insertion of the tool, the leading projection of the flexible lance is slid on the slanted face, so that the sliding point on the leading projection is moved upwardly while the flexible lance is bending in the direction for removing the terminal from the engagement with the flexible lance.

When further inserting the terminal extracting tool into the tool hole, then the bending of the flexible lance is progressed furthermore by the sliding effect of the leading projection, so that both sliding points on the leading projection and the engagement projection will be included within the range of height of the slanted face: at this stage, there may be existing both cases that the sliding point on the engagement projection is in contact with the slanted face and that the sliding point on the engagement projection is not in contact with the slanted face.

At this time, since the slanting angle θ of the slanted face of the tool and the angle α of the tangential line linking the sliding point with the sliding point meet the relationship of $\theta \geqq \alpha$, the engagement projection can be picked up on the slanted face certainly. Thus, the pick-up of the engagement projection allows the flexible lance to be further bent upward while the engagement projection is sliding on the slanted face certainly. In this way, the engagement projection is separated from the shoulder of the terminal and released therefrom finally.

In the present invention, preferably, the angle θ of the slanted face is established to be equal to or less than 60°.

In this case, it is possible to increase a ratio of lifting force due to the flexible lance to an insertion force of the tool, so that the engagement of the flexible lance can be released with a little force. Note, actually, the angle θ of the slanted face is more desirable to be approx. 45° in view of the balance between the insertion force and the lifting force.

Alternatively, the angle α of the tangential line may be established to be equal to or less than 60°.

Also in this case, it is possible to increase the ratio of lifting force due to the flexible lance to then insertion force of the tool, so that the engagement of the flexible lance can be released with such a little force.

According to the present invention, there is also provided a terminal extracting tool for extracting a terminal inserted into a connector therefrom, the connector including:

a connector housing having a terminal accommodating chamber formed to accommodate the terminal therein;

a tool hole formed at a front end of the connector housing;

a flexible lance formed in the terminal accommodating chamber, the flexible lance having a free end extending toward the front end, whereby the flexible lance is capable of bending in a direction of height of the terminal accommodating chamber;

an engagement projection formed at a part of the free end of the flexible lance to project to a direction of bending thereof; and a leading projection formed at a part of the free end of the flexible lance to project toward the front end;

wherein the terminal can be prevented from escaping from the terminal accommodating chamber by an engagement of the engagement projection with a shoulder of the terminal, the terminal extracting tool comprising:

a rod-shaped leading end provided with a slanted face which is inclined to the inserting direction of the terminal;

wherein an angle θ of the slanted face is established to be equal to or more than an angle α of a tangential line linking a sliding point on the leading projection with another sliding point on the engagement projection, both of the sliding points being included within a range of height H of the slanted face;

wherein the angle α is an angle defined by the tangential line and the inserting direction of the terminal extracting tool.

The operation of the terminal extracting tool is similar to that of the above-mentioned terminal extracting arrangement.

Therefore, it is also preferable that, in this tool, the angle θ of the slanted face is established to be equal to or less than 60°.

Furthermore, according to the invention, there is also provided a connector for engagement with a terminal, the terminal being disengageable from the connector by inserting a terminal extracting tool into the connector, the terminal extracting tool including a rod-shaped leading end provided with a slanted face which is inclined to the inserting direction of the terminal, the connector comprising:

a connector housing having a terminal accommodating chamber formed to accommodate the terminal therein;

a tool hole formed at a front end of the connector housing;

a flexible lance formed in the terminal accommodating chamber, the flexible lance having a free end extending toward the front end, whereby the flexible lance is capable of bending in a direction of height of the terminal accommodating chamber;

an engagement projection formed at a part of the free end of the flexible lance to project to a direction of bending thereof; and a leading projection formed at a part of the free end of the flexible lance to project toward the front end;

wherein the terminal can be prevented from escaping from the terminal accommodating chamber by an engagement of the engagement projection with a shoulder of the terminal;

wherein dimensions of the engagement projection and the leading projection are established in a manner that an angle α of a tangential line linking a sliding point on the leading projection with another sliding point on the engagement projection is equal to or less than an angle θ of the slanted face;

wherein both of the sliding points are included within a range of height H of the slanted face and the angle a is an angle defined by the tangential line and the inserting direction of the terminal extracting tool.

The operation of the connector is similar to that of the above-mentioned terminal extracting arrangement.

Therefore, it is also preferable that, in this connector, the angle α of the tangential line is established to be equal to or less than 60°.

These and other objects and features of the present invention will become more fully apparent from the following description and appended claims taken in conjunction with the accompany drawing.

DESCRIPTION OF THE PREFERRED EMBODIMENT

An embodiments of the present invention will be described with reference to the drawings.

Figure 1A:
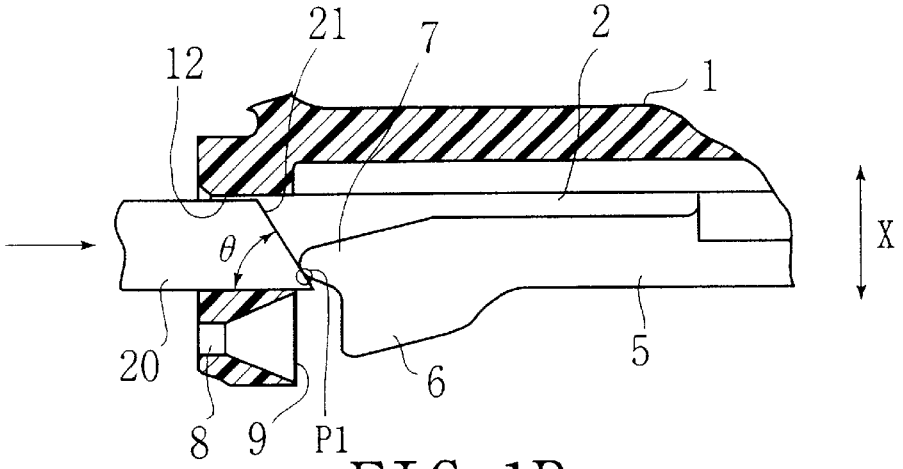
FIG. 1A PRIOR ART
FIGS. 1A, 1B and 1C are cross sectional views of essential parts of the conventional connector and the conventional terminal extracting tool, showing respective structures and operations thereof.
Figure 1B:
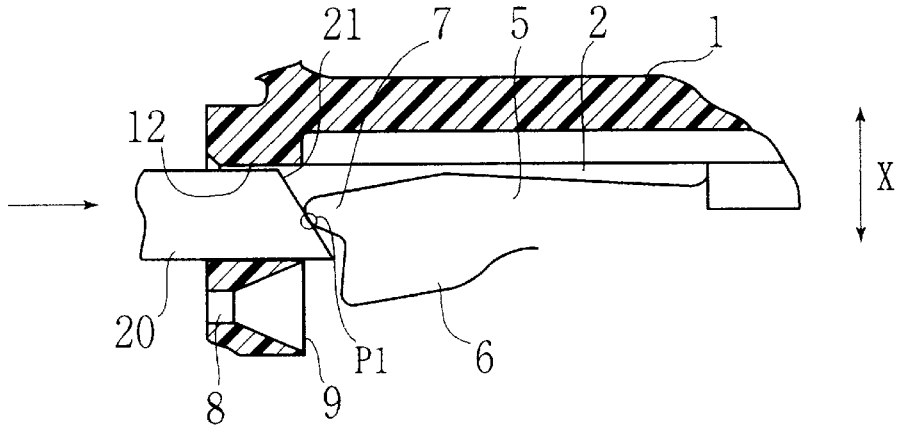
FIG. 1B PRIOR ART
Figure 1C:
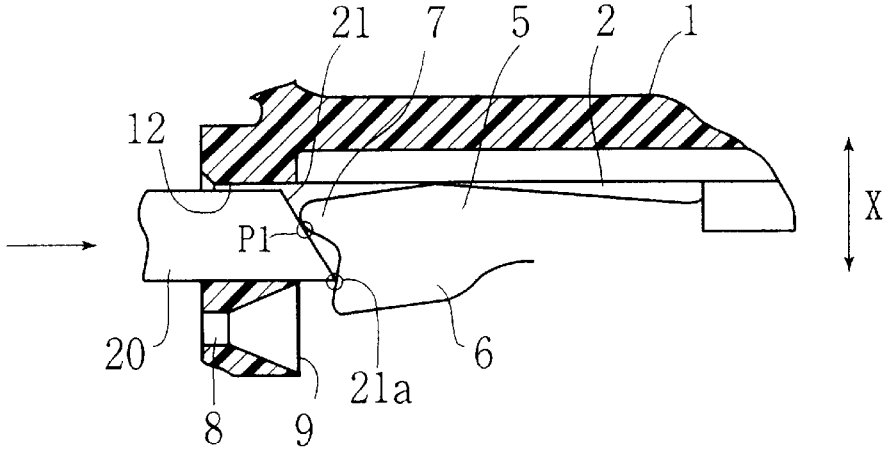
FIG. 1C PRIOR ART
Figure 2:
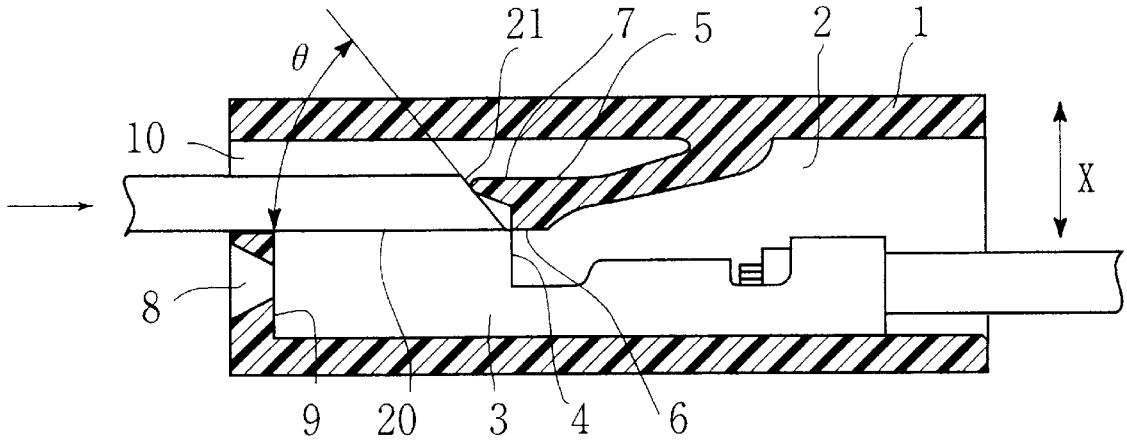
FIG. 2 is a cross sectional view of the connector and the terminal extracting tool in accordance with the present invention, showing a conceptual structure thereof.

First of all, referring to FIG. 2, we now describe a basic structure of a connector.

In FIG. 2, a connector housing 1 is provided with a terminal accommodating chamber 2 info which a terminal 3 is inserted from the rear, i.e. the right side of the figure, of the connector. Being abutted against a front wall 9 of the connector housing 1, the inserted terminal 3 is prevented from escaping to the rear by a flexible lance 5. The flexible lance 5 has a free end extending from an inner wall defining the terminal accommodating chamber 2 to the forward end of the connector, i.e. the left side of the connector. Thus, the flexible lance 5 is so constructed so as to be capable of bending in a direction of the height of the terminal accommodating chamber 2, i.e. a direction of arrow X of FIG. 2.

The flexible lance 5 is provided, at a leading end thereof, with an engagement projection 6 protruding in the bending direction of the lance 5. In addition, at a tip of the engagement projection 6, a leading projection 7 is formed to project forwardly.

In operation, by engaging the engagement projection 6 of the flexible lance 5 with an engagement shoulder 4 of the terminal 3 inserted from the rear of the connector housing 1, the terminal 3 can be prevented from escaping backwardly.

Reference numeral 8 denotes an insertion hole through which a not-shown plug of the terminal 3 or the mating terminal passes.

On the other hand, a terminal extracting tool 20, which is partially shown in the figure, has a rod-shaped leading end to be inserted into the connector housing 1 through a tool hole 10 formed in a front wall 9. In detail, the tool 20 is formed in a manner that a slanted face 21 of the leading end abuts on the end of the flexible lance 5 by inserting the leading end of the tool 20 into the terminal accommodating chamber 2 straight.

When extracting the terminal 3 by means of the terminal extracting tool 20, the leading end is firstly inserted into the chamber 2 through the tool hole 10 so as to abut on the end of the flexible lance 5. Then, the flexible lance 5 slides on the slanted face 21 with an inserting movement of the tool 20, while the flexible lance 5 is bent upwardly, i.e. in the direction of disengagement, so that the projection 6 will be released from the shoulder 4 of the terminal 3. In this way, the terminal 3 can be extracted from the rear of the connector housing 1.

Figure 3A:
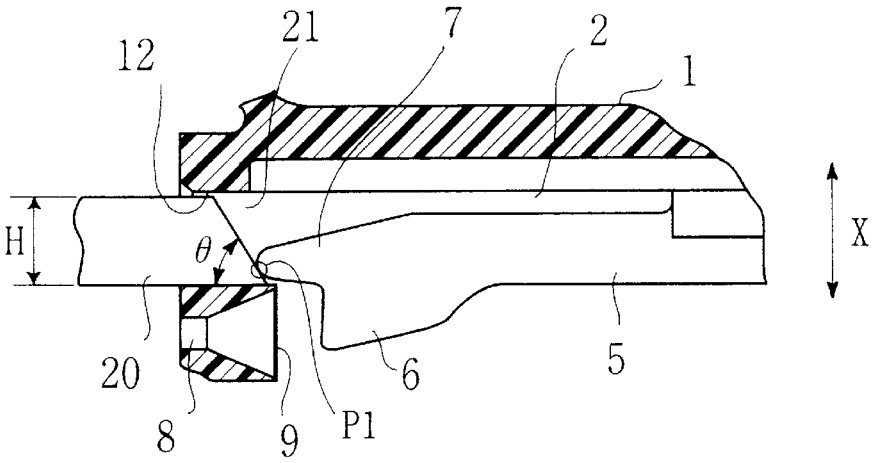
FIG. 3A, 3B and 3C are cross sectional views of essential parts of the connector and the terminal extracting tool in accordance with an embodiment of the present invention, showing detailed structures and operations thereof.
Figure 3B:
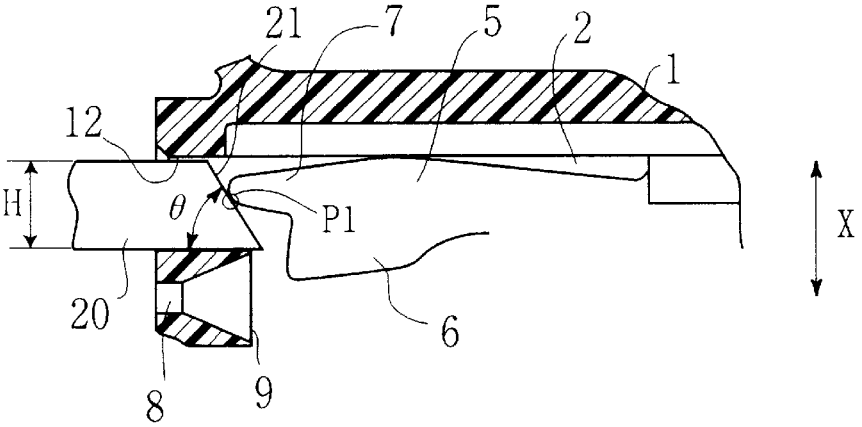
Figure 3C:
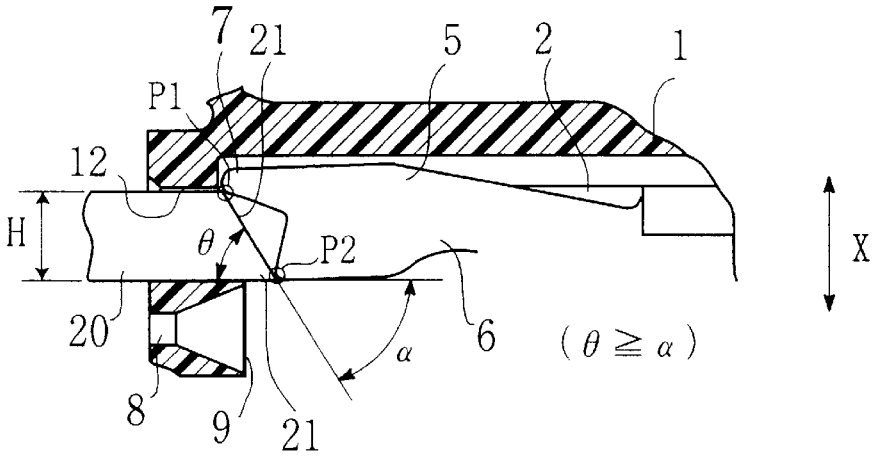

FIGS. 3A to 3C illustrate a variety of operational situations of the connector in accordance with one embodiment of the invention. Note, in the figures, elements similar to those of FIG. 2 are indicated with the same reference numerals, respectively.

Through FIGS. 3A to 3C, the shown connector housing 1 is provided with a tool hole 12 of which height (between an upper wall and a lower wall) is substantially equal to a height of the terminal extracting tool 20 in order to allow it to be inserted and guided into the terminal accommodating chamber 2 straight. Further, different from the connector housing 1 of FIG. 2, the flexible lance 5 of FIGS. 3A to 3C is disposed so as to be adjacent to the insertion hole 8.

According to this embodiment, dimensions of the projections 6, 7 and an angle θ of the slanted face 21 are established so as to meet a relationship as follows.

The relationship is that, as shown in FIG. 3C, when both a sliding point P1 on the leading projection 7 and another sliding point P2 on the projection 6, i.e. respective contacts of the projections 6,7 with the flexible lance 5, are within a range of height H of the slanted face 21, an angle α of a tangential line 30 linking the point P1 with the point P2 will meet a relationship of $$60° \geqq \theta \geqq \alpha,$$

wherein α is an angle defined by the line 30 and the inserting direction of the tool 20.

The so-constructed connector housing 1 operates as follows.

In order to extract the terminal (not shown in FIGS. 3A to 3C) engaged by the flexible lance 5 and accommodated in the terminal accommodating chamber 2 of the connector housing 1, the leading end of the terminal extracting tool 20 is inserted into the terminal accommodating chamber 2 through the tool hole 12 at the front end of the connector housing 1. Consequently, the tool 20 is brought into contact with the end of the flexible lance 5, as shown in FIG. 3A.

Then, with the farther insertion of the tool 20, the leading projection 7 of the flexible lance 5 is slid on the slanted face 21 while the sliding point P1 is moved upwardly as shown in FIG. 3B, so that the flexible lance 5 bends in the direction for removing the terminal from the engagement with the flexible lance 5.

When further inserting the terminal extracting tool 20 into the tool hole 12, then the bending of the flexible lance 5 is progressed furthermore by the sliding effect of the leading projection 7, so that both sliding points P1, P2 on the projections 7, 6 will be included within the range of height H of the slanted face 21, as shown in FIG. 3C. It should be noted that, at this stage, there may be existing a case that the sliding point P2 of the engagement projection 6 is in contact with the slanted face 21 and the opposite case that the sliding point P2 of the engagement projection 6 is not in contact with the slanted face 21.

At this time, since the slanting angle θ of the slanted face 21 of the tool 20 and the angle α of the tangential line 30 connecting the sliding point P1 with the sliding point P2 meet the relationship of θ≧α, the engagement projection 6 can be picked up on the slanted face 21 with certainty. Thus, the pick-up of the projection 6 allows the flexible lance 5 to be further bent upward while the projection 6 is sliding on the slanted face 21 certainly. In this way, the engagement projection 6 is separated from the shoulder of the terminal and released therefrom finally.

Accordingly, according to the embodiment, there can be excluded a possibility that the flexible lance 5 cannot be further lifted since the tip 21*a* of the slanted face 21 has collided against the front face of the projection 6, i.e. the impossibility of disengagement.

Furthermore, since the slanting angle θ of the slanted face 21 of the tool 20 and the angle α of the tangential line 30 are established so as to be less than 60° respectively, it is possible to increase a ratio of lifting force due to the flexible lance 5 to an insertion force of the tool 20, so that the engagement of the flexible lance 5 can be released with a little force. It should be noted that, actually, the angle θ of the slanted face 21 is desirable to be approx. 45° in view of the balance between the insertion force and the lifting force.

Although the sort of terminal has not been specified in the above-mentioned embodiment, the arrangement of the present invention may be applicable in either cases of engaging with a male terminal and engaging with a female terminal. In connection, the connector housing may be either of female-type and male-type.

Finally, it will be understood by those skilled in the art that the foregoing description is one of preferred embodiments of the disclosed arrangement, and that various changes and modifications may be made to the present invention without departing from the spirit and scope thereof.

What is claimed is:

1. A terminal extracting assembly comprising:

a connector including:

a connector housing having a terminal accommodating chamber formed to accommodate a terminal therein;

a tool hole formed at a front end of said connector housing;

a flexible lance formed in said terminal accommodating chamber, said flexible lance having a free end extending toward said front end, whereby said flexible lance is capable of bending in a direction of height of said terminal accommodating chamber;

an engagement projection formed at a part of said free end of said flexible lance to project toward a direction of bending thereof, said engagement projection having a first sliding point, said engagement projection being engageable with a shoulder of the terminal;

a leading projection formed at a part of said free end of said flexible lance to project toward said front end, said leading projection having a second sliding point;

and a terminal extracting tool insertable into said terminal accommodating chamber in an insertion direction through said tool hole for releasing an engagement of said engagement projection of said flexible lance with the terminal, said terminal extracting tool including a leading end provided with a slanted face which is inclined with respect to the insertion direction;

wherein an angle θ of said slanted face is established to be equal to or more than an angle α of a tangential line linking the second sliding point on said leading projection with the first sliding point on said engagement projection, both of said sliding points being included within a range of a height H of said slanted face;

wherein said angle α is an angle defined by said tangential line and the insertion direction of said terminal extracting tool.

2. A terminal extracting arrangement as claimed in claim 1, wherein said angle θ of said slanted face is established to be equal to or less than 60°.

3. A terminal extracting arrangement as claimed in claim 1, wherein said angle α of said tangential line is established to be equal to or less than 60°.

4. A terminal extracting tool insertable into a connector for extracting a terminal therefrom, the connector including:

a connector housing having a terminal accommodating chamber formed to accommodate a terminal therein;

a tool hole formed at a front end of the connector housing;

a flexible lance formed in the terminal accommodating chamber, the flexible lance having a free end extending toward the front end, whereby the flexible lance is capable of bending in a direction of height of the terminal accommodating chamber;

an engagement projection formed at a part of a free end of the flexible lance to project to a direction of bending thereof the engagement portion having a first sliding point; and a leading projection formed at a part of the free end of the flexible lance to project toward the front end, the leading projection having a second sliding point;

wherein the terminal can be prevented from escaping from the terminal accommodating chamber by an engagement of the engagement projection with a shoulder of the terminal, said terminal extracting tool comprising:

a leading end insertable in an insertion direction through the tool hole and provided with a slanted face which is inclined with respect to the insertion direction;

wherein an angle θ of said slanted face is established to be equal to or more than an angle α of a tangential line linking the second sliding point on the leading projection with the first sliding point on the engagement projection, both of the sliding points being included within a range of a height H of said slanted face;

wherein said angle α is an angle defined by the tangential line and said insertion direction of said terminal extracting tool.

5. A terminal extracting tool as claimed in claim 4, wherein said angle θ of said slanted face is established to be equal to or less than 60°.

6. A connector for engagement with a terminal, the terminal being disengageable from the connector by inserting a terminal extracting tool into the connector, the terminal extracting tool including a leading end provided with a slanted face which is inclined with respect to an insertion direction of the tool, said connector comprising:

a connector housing having a terminal accommodating chamber formed to accommodate the terminal therein;

a tool hole formed at a front end of said connector housing;

a flexible lance formed in said terminal accommodating chamber, said flexible lance having a free end extending toward said front end, whereby said flexible lance is capable of bending in a direction of height of said terminal accommodating chamber;

an engagement projection formed at a part of said free end of said flexible lance to project to a direction of bending thereof, said engagement projection having a first sliding point; and a leading projection formed at a part of said free end of said flexible lance to project toward said front end, said leading projection having a second sliding point;

wherein a shoulder of the terminal is engageable with said engagement projection;

wherein dimensions of said engagement projection and said leading projection are established in a manner that an angle α of a tangential line linking the second sliding point on the leading projection with the first sliding point on the engagement projection is equal to or less than an angle θ of the slanted face; and wherein both of said sliding points are included within a range of height H of the slanted face and said angle α is an angle defined by the tangential line and the insertion direction of the terminal extracting tool.

7. A connector as claimed in claim 6, wherein said angle α of said tangential line is established to be equal to or less than 60°.

* * * * *